US008701880B2

(12) United States Patent
Noel

(10) Patent No.: US 8,701,880 B2
(45) Date of Patent: Apr. 22, 2014

(54) PACKAGE HAVING A TEARABLE INTERNAL POUCH PROVIDED WITH A RUPTURING MEANS

(76) Inventor: Eric Noel, Equilles (FR)

( * ) Notice: Subject to any disclaimer, the term of this patent is extended or adjusted under 35 U.S.C. 154(b) by 0 days.

(21) Appl. No.: 14/000,792

(22) PCT Filed: Feb. 17, 2012

(86) PCT No.: PCT/EP2012/052812

§ 371 (c)(1),
(2), (4) Date: Oct. 24, 2013

(87) PCT Pub. No.: WO2012/113734

PCT Pub. Date: Aug. 30, 2012

(65) Prior Publication Data

US 2014/0034524 A1 Feb. 6, 2014

(30) Foreign Application Priority Data

Feb. 21, 2011 (FR) ..... 1100513

(51) Int. Cl.
*B65D 25/08* (2006.01)

(52) U.S. Cl.
USPC ..... 206/222

(58) Field of Classification Search
USPC ..... 206/219, 222, 205, 484; 362/34
See application file for complete search history.

(56) References Cited

U.S. PATENT DOCUMENTS

| | | | | |
|---|---|---|---|---|
| 3,539,794 | A * | 11/1970 | Kennerly et al. | 362/34 |
| 4,067,313 | A * | 1/1978 | Donnelly | 126/263.1 |
| 4,387,804 | A * | 6/1983 | Austin | 206/218 |
| 4,548,322 | A * | 10/1985 | Cullen et al. | 206/526 |
| 6,712,201 | B1 * | 3/2004 | Bertram et al. | 206/219 |
| 6,945,402 | B1 * | 9/2005 | Gueret | 206/581 |
| 7,887,231 | B2 * | 2/2011 | Suchan et al. | 366/130 |
| 8,443,970 | B2 * | 5/2013 | Coon | 206/222 |
| 2003/0223219 | A1 * | 12/2003 | Ladyjensky | 362/34 |
| 2005/0087458 | A1 * | 4/2005 | Richards et al. | 206/219 |

* cited by examiner

*Primary Examiner* — Jacob K Ackun
(74) *Attorney, Agent, or Firm* — McHale & Slavin, P.A.

(57) ABSTRACT

The invention relates to a package having flexible walls, such as a sachet or an external pouch made of plastic, which is intended to contain a first product and at least one flexible internal pouch which can be ruptured or torn and contains a second product, preferably liquid, which is intended to be mixed with said first product in said sachet or said external pouch. The internal pouch is secured to an essentially rigid panel which has a preferential folding line that may be provided with a cut-out that projects at the moment of folding.

22 Claims, 5 Drawing Sheets

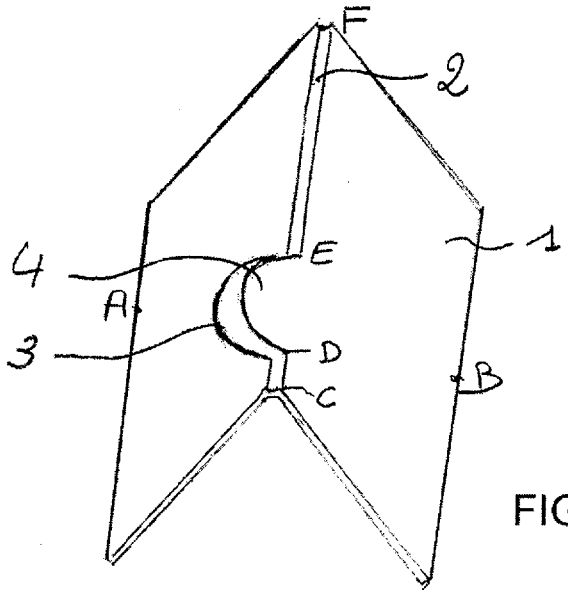
FIG. 1
FIG. 2
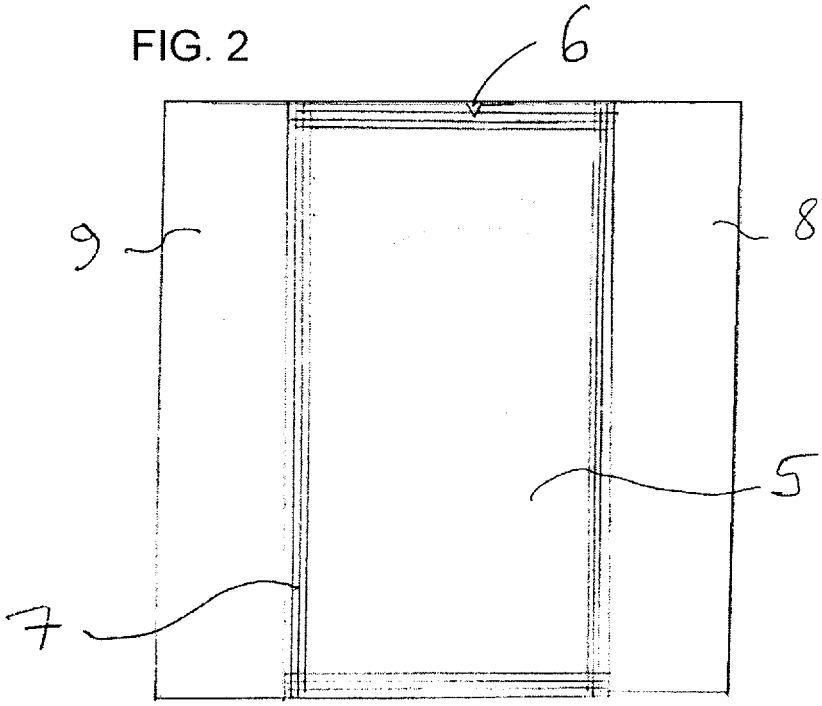

PACKAGE HAVING A TEARABLE INTERNAL POUCH PROVIDED WITH A RUPTURING MEANS

CROSS REFERENCE TO RELATED APPLICATIONS

This is a national stage filing in accordance with 35 U.S.C. §371 of PCT/EP2012/052812, filed Feb. 17, 2012, which claims the benefit of the priority of French Patent Application No. 1100513, filed Feb. 21, 2011, the contents of each are incorporated herein by reference.

SCOPE OF THE INVENTION

The present invention is related to a package with flexible walls, such that a sachet or external pouch made of plastic material, intended to contain a first product and at least one flexible internal pouch, which can be ruptured or torn, containing a second product in the form of a liquid, powder, or gas, or in the form of a gel intended to be mixed with the said first product in the said sachet or the said external pouch.

This type of package finds application in a large number of industrial fields, such as, for example, the field of cosmetics, particularly products for cleaning and coloring the hair. Some of these products require the separate packaging of two or several components to be mixed before use. Another field of application is pharmaceuticals, particularly when two or several products must be mixed a little before administering.

Heating or cooling pouches are likewise known, used particularly in survival kits, which generate heat or cold as a result of the reaction between two products packaged in separate pouches and mixed following the rupture of at least one of them.

This type of package is also useful in applications of chemiluminescence, such as elements for chemiluminescent lighting in which the light is produced by a reaction between two products whose mixture has been enabled.

TECHNICAL BACKGROUND

U.S. Pat. No. 3,539,794 (Rauhut, American Cyanamid, 1970) mentions a first sealed pouch containing a liquid included in a second sealed pouch and containing another liquid, with the means for breaking open the first pouch but without describing the means used.

The document EP-1421314 (Ladyjenski) describes a pouch of aluminum film containing an oxalate solution, disposed in the interior of a pouch of translucent plastic film also containing the enhancing solution. The device includes a steel ball or grain of hard matter whose role is to burst the aluminum pouch at the time of use, caused by the user's manipulation.

This device, however, presents certain drawbacks, of which is, in particular, the risk of unwanted piercing of the internal sachet during various manipulations, including during fabrication, filling, transport, and/or prolonged storage.

In addition, laminated, multilayer packaging films are very resistant, as a consequence of the materials chosen for their fabrication, particularly polyethylene, polypropylene, or PVC as a first layer, aluminum as a barrier film, and generally a layer of polyester film serving to protect the extremely thin aluminum barrier. The use of a ball or a grain of hard matter is not suited to breaking this type of film.

In addition, the use of a cutting object integral with the package does not appear to be adequate, either in view of the risk of undesirable rupture of the external pouch of the package or of the rupture of the internal pouch.

OBJECT OF THE INVENTION

The goal of the invention thus aims to provide a package of the abovementioned type which is suited to the fields of application mentioned and which could possibly call for known laminated, multilayer packaging films and which include a means of rupturing the internal pouch, while reducing the risks of undesirable rupture of the external pouch.

This goal is achieved by providing a package of the abovementioned type, fitted with a means of rupture that consists of an essentially rigid but flexible plate, preferably without breaking, which includes a preferential folding region or line, and on which at least internal pouch is securely brought together.

According to a first embodiment of the invention, the internal pouch occupies essentially the entire surface of the small plate. According to another embodiment, the small plate can include two internal pouches.

Advantageously, a preferential fold line consists of a groove executed at a significant depth on the said small plate. It results from this that, when folding the edges of the said groove, they open up in order to thus create tension in the film or sheet of the adjacent pouch, essentially of low elasticity or non-elastic under tension, brought together at the small plate. This tension suffices to tear the said adjacent film. According to one embodiment, the upper edges of the groove can thus promote the tearing of the film or sheet. The rupture of this film, which forms the internal pouch, henceforth allows the mixing and the reaction of the product contained in this internal pouch with the product contained in the external pouch.

In order to still facilitate the rupture, the preferential fold line, at first straight, can be interrupted by an outline in the form of an elbow or tooth, such that when folding the small plate, this elbow or this tooth forms a projecting part, which exerts even greater tension on the adjacent film brought together at the said small plate. This tension, possibly completed with a effect of a point in the case of a line in dentate form, leads to the rupture of the film that forms the internal pouch, thus allowing the mixture of the product contained in this internal pouch with the product contained in the external pouch.

Advantageously, the film or sheet making up the internal pouch includes a notch or tongue facilitating the tearing. Preferably, this notch or tongue is laid out to act in cooperation with the preferential fold line of the small plate or, when this fold line includes one or a plurality of elbows or teeth, in cooperation with the support of this elbow or this tooth on the adjacent film when folding said small plate, in order to still facilitate the tearing or the rupture of the internal pouch in question.

It is well understood that for tension to be exerted on the film in order to tear or rupture it, the latter should be brought firmly and securely together at the small plate. To do this, according to one embodiment, legs or flaps are advantageously provided along the length of two opposite sides of the internal pouch, on either side of the fold line or zone, and glued, riveted, or welded onto the small plate essentially parallel to the preferential fold line or zone.

Advantageously, the small plate is sized such that these legs or flaps of the internal pouch can be folded up around the corresponding extreme ends of the small plate and glued, riveted, or welded onto the small plate face opposite the face adjacent to the pouch.

Advantageously, the means of fastening, gluing, riveting, or welding at the flap will be located at least at the abscissa of the cut-out, tooth, elbow, or boss.

In a variant, the small plate can also be glued, riveted, or welded onto the film that forms the internal pouch, and this to the interior of the latter. Folding the small plate will then lead to the rupture or tearing of the film onto which it is glued or welded and to the flow of the product in the internal pouch into the external pouch.

According to a less preferred embodiment, folding the small plate causes a break or rupture than can lead to the separation of said plate into two parts.

DESCRIPTION OF THE FIGURES

The invention is described in more detail below, referring to the drawings attached, in which:

FIG. 1 shows a small plate folded according to a preferred embodiment of the invention;

FIG. 2 shows an internal pouch according to an advantageous embodiment of the invention;

DETAILED DESCRIPTION OF THE INVENTION

Figure 3:
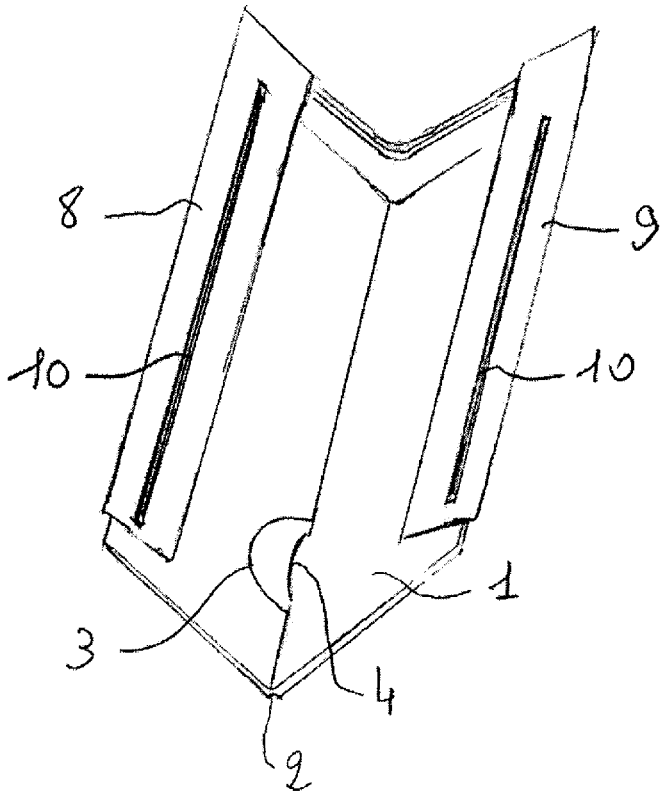
FIG. 3 shows the assembly of the internal pouch brought together with the folded small plate, seen from the side opposite to that of FIG. 1.

The invention therefore relates to a package with flexible walls, such as a sachet or an external pouch made of plastic material, intended to contain a first product and at least one flexible, internal pouch that can be ruptured or torn containing a second essentially liquid product or in the form of a gel intended to be mixed with the said first product in the said sachet or the said external pouch in order to generate light, heat, cold, or to produce a cosmetic or pharmaceutical or other mixture.

According to the invention, as illustrated more particularly in FIGS. 1 and 2, a means is provided to rupture the internal pouch, which consists of a small plate 1 including a preferential folding line 2 consisting of a groove executed in the thickness of the small plate allowing it to be easily articulated on either side of this groove. The internal pouch 5 is brought together on the small plate 1. The small plate 1 is advantageously sized in order to be able to be accommodated in the sachet or the external pouch. The preferential fold line (groove 2) is interrupted locally by a cut-out in the form of an elbow 3 such that when folding, a projecting element or linear boss 4 is obtained which exerts a tension force on the film of the pouch brought together with said small plate.

The internal pouch 5 can be made up of a laminated, multilayer film known in and of itself, or a sheet of aluminum coated with a welding veneer and hermetically sealed in order to contain a essentially fluid product, for example a liquid, a powder, or a gel. This pouch can advantageously include a rupture notch or tongue 6 facing the boss obtained when folding the small plate onto which the internal pouch is applied. According to the embodiment depicted, the small plate presents essentially the same surface area as that of the internal pouch.

During fabrication, the whole can then be arranged in a pouch or outer envelope made of a plastic material, laminated, multilayered, preferably translucent, which receives yet a second product before being hermetically welded.

In order to intimately connect the internal pouch 5 to the small plate 1, two legs 8, 9 or flaps are provided, on two opposite sides of the internal pouch. The pouch is then laid on the small plate 1 on the face including the groove 2 such that the legs 8, 9 extend beyond the small plate and are parallel to said groove. These legs are then folded up on the side opposite the small plate and advantageously welded or glued.

Figure 4:
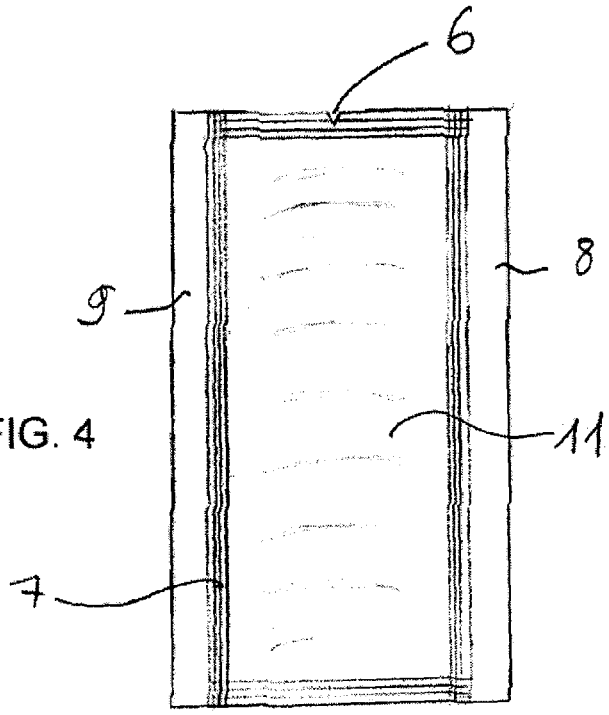
FIG. 4 shows another embodiment of the internal pouch.
Figure 5:
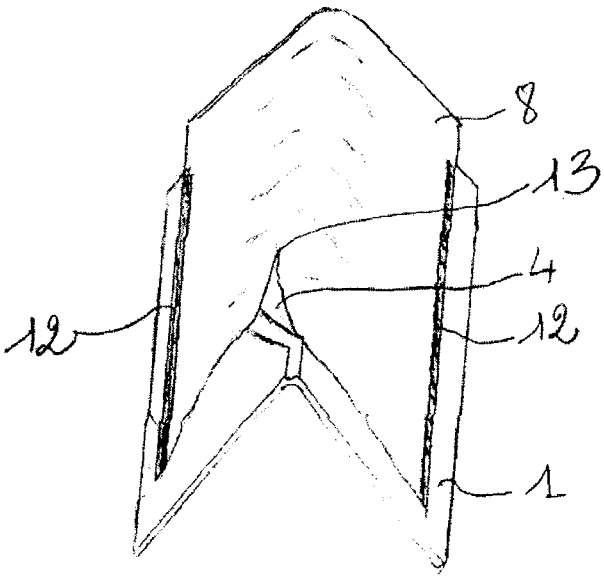
FIG. 5 illustrates the assembly of the pouch from FIG. 4 with a folded small plate.

In a variant, and depending on use requirements, a small plate can also be provided having at least one dimension greater than the pouch to be brought together there and to weld or glue the legs or flaps 8, 9 onto the face of the small plate that includes the groove, as illustrated in FIGS. 4 and 5.

The pouches can be executed in a manner known in and of itself. A strip segment of film can be used, folding it up and welding it on three edges; the legs or flaps can then be applied separately by gluing or welding or else they are made by the material flowing over on the welded sides. The pouches can also be formed fitted with legs by superposing two films welded on four sides. A person skilled in the art will readily determine how best to achieve the object of the invention. The choice of film thickness, the type of film, and the coating material will depend on the final application of the whole, the products to be contained, etc., but the necessary adaptations alter nothing in the invention.

Figure 6:
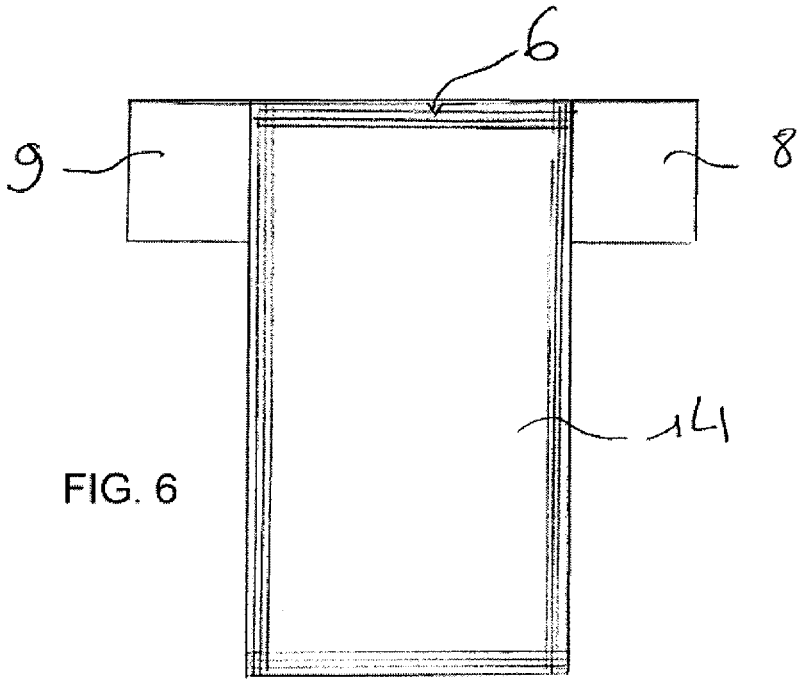
FIG. 6 illustrates an internal pouch according to another embodiment of the invention.

According to another execution variant, a rectangular and hermetically sealed, internal pouch 14 is provided (see FIG. 6) that is slightly different from that of FIG. 2 in the dimensions of the legs. The film of the sachet consists of a three-layer film in which an exterior layer is polyester, a sheet of aluminum, and an interior welding layer of poly-ethylene. The pouch still includes a notch 6 of about 1 mm, executed in the welded zone.

Figure 7:
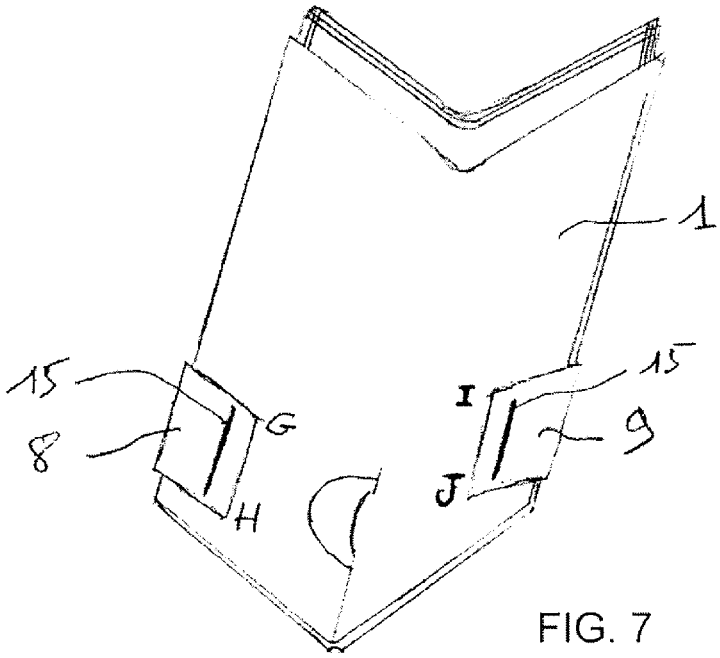
FIG. 7 is a view similar to that of FIG. 3, of an assembly using the internal pouch of FIG. 6.

By way of example, a small plate made of polypropylene or of high-density polyethylene (HDPE) is provided, with a thickness of 1.5 mm with dimensions roughly equal to the sachet without its legs grooved on the line lengths CD and EF at a depth of 1.2 mm. A cut-out 3 is executed forming an elbow 4 which forms an arc with radius of 6 mm. The sachet 14 is placed on the plate 1 on the groove 2 side and positioned such that the notch 6 is at the highest level of the arc formed by the elbow or boss. The legs 8, 9 of FIG. 7 are folded up onto the side opposite the plate, tightened and welded 15 onto the plate 1 at the line lengths GH and IJ.

The whole can be introduced into an external pouch made of transparent polypropylene, sealed on three sides and sized for this purpose. Another liquid is introduced into this pouch and then the last side is sealed in turn.

According to the embodiment depicted, the legs 8, 9 are welded to the small plate 1 that is advantageously positioned a short distance from the boss. In this case, the force exerted when folding the plate is concentrated on the pouch only at GH and IJ, thus facilitating the rupture of the pouch.

Figure 8:
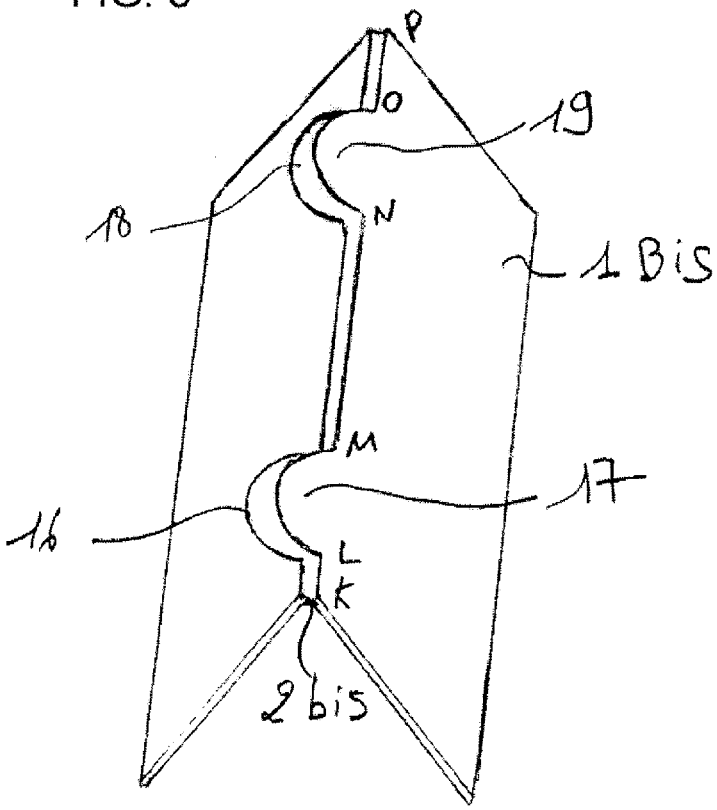
FIG. 8 shows an embodiment variant of the small support plate.

According to yet another embodiment variant, two pouches are executed similar to those of example 1, each of which contains a different liquid. A notch 6 is executed in the same way as in example 1 at each of the pouches. A small plate 1 bis (see FIG. 8) made of HDPE having a thickness of 1.5 mm and dimensions roughly equal to the size of sachets without legs is grooved at the line lengths KL, MN, OP at a depth of 0.6 mm, and then a second identical grooving 2 bis is executed on the opposite face of the small plate. A cut-out 16 forming a boss 17 forms an arc LM with radius of 6 mm and diameter LM. A second cut-out 18 forming an identical boss 19 is executed which forms an arc NO with radius of 6 mm and diameter NO. A pouch is positioned on the small plate such that the notch 6 is at the highest level of the arc of cut-out LM. Its legs 8, 9 are folded up on the opposite side of the small plate, tightened and welded onto the small plate in the same manner as in example 1. The other pouch is positioned on the opposite side of the small plate such that its notch 6 is at the highest level of the arc of cut-out NO. Its legs 8, 9 are folded up on the opposite side of the small plate, tightened and welded onto the latter. The whole can then be introduced into a transparent envelope or external pouch that can then be hermetically sealed. The user who is trying to mix the products and cause them to react can fold the whole manually on the longitudinal axis of the small plate, first on one side to cause a first pouch to rupture and then on the other side to cause the second sachet to rupture, thus allowing the mixing of the products, liquids, solids, and/or gels.

This embodiment is advantageous when the two contents require packaging in a laminated, multilayer, barrier pouch in order to ensure their good preservation over time or when the mixing that is desired to be obtained is the mixing of three components, the third being contained in the external pouch.

It will be noted that the small plates can be obtained by a cut-out and grooving appropriate for plates fabricated in a manner known in and of itself. The small plates can also be produced on a large scale by injection molding, obtaining the small plates fitted with their groove in a single step.

The small plate can have different, non-rectangular contours. Actually, the words "small plate" cover any element presenting a more or less central, flat and flexible zone and therefore can assume very different shapes. The small plate thus defined can include rigid, non-flexible zones or rigid, projecting parts.

The small plate can also be executed in two pieces glued to one another along the plane of the groove or slit, with a hinge added, made of a supple material, thus replacing an integral hinge.

The invention claimed is:

1. A package with flexible walls, such that an outer sachet or pouch made of plastic material, intended to contain a first product and at least one flexible, internal pouch that can be ruptured or torn, containing a second product intended to be mixed with the said first product in the said outer sachet or the said external pouch, characterized in that it includes a small plate which presents a preferential fold line or zone and on which at least the said internal pouch is firmly brought together, such that folding the said small plate causes the rupture of the internal pouch.

2. The package according to claim 1, in which the internal pouch is made of a laminated, multi-layer packaging film or a sheet of aluminum coated with a welding veneer.

3. The package according to claim 1, in which the small plate is made of a plastic material.

4. The package according to claim 1, in which the internal pouch is tightened.

5. The package according to claim 1, characterized in that the internal pouch occupies essentially the entire surface of the small plate.

6. The package according to claim 1, characterized in that the film is brought together at the small plate by gluing, riveting, or welding to legs, flaps, or small flaps extending the length of the two opposite sides of the internal pouch, essentially parallel to the preferential fold line.

7. The package according to claim 6 characterized in that the small plate is sized such that the legs or flaps of the internal pouch are folded around the extreme ends corresponding to the small plate and glued, riveted, or welded onto the small plate surface opposite the face adjacent to the pouch.

8. The package according to claim 1, characterized in that two internal pouches are brought together on the small plate.

9. The package according to claim 1, characterized in that the preferential fold line consists of a groove executed at a significant depth at said small plate.

10. The package according to claim 1, characterized in that the preferential, straight fold line is interrupted by a cut-out in the form of an elbow or a tooth, such that when folding the small plate, this elbow or this tooth forms a projecting part, which exerts tension on the adjacent film brought together at said small plate.

11. The package according to claim 10, in which the means of fastening, gluing, or welding is located at the abcissa of the cut-out.

12. The package according to claim 1, characterized in that the film constituting the internal pouch includes a lateral notch or tongue facilitating the tearing.

13. The package according to claim 12, characterized in that this notch or tongue is constructed so as to operate with the preferential fold line of the small plate or, when this fold line includes one or a plurality of elbows or teeth, to operate with the support of at least one elbow or of one tooth on the adjacent film while folding said small plate.

14. The package according to claim 1, characterized in that it includes two internal pouches fitted with a notch brought together on a small plate (1 bis) with dimensions roughly equal to the size of sachets without legs, and grooved on each face, the said grooves being interrupted on one face by a cut-out forming a boss at the fold, and on the other face by a second cut-out forming a boss, the notch of the first internal pouch being positioned on the small plate at the highest level of the cut-out and the corresponding legs of the pouch being folded up and welded onto the side opposite the small plate, the notch of the second internal pouch being positioned on the face opposite the small plate at the highest level of the cut-out and the corresponding legs of the pouch being folded up and welded onto the side opposite the small plate, the small plate fitted with two internal pouches being accommodated in a transparent, hermetically sealed envelope or external pouch.

15. The package according to claim 1, characterized in that the first and/or the second product is a liquid, a gel, a paste, a solid, a powder, or a gas.

16. A package with flexible walls, such as a sachet or an external pouch made of plastic material, intended to contain a first product and at least a flexible, internal pouch that can be ruptured or torn, containing a second product intended to be mixed with the said first product in the said sachet or the said external pouch, characterized in that it includes a small plate with an roughly rectangular shape, capable of being easily folded by the user with two hands, which, through the external pouch, hold the small plate by its short sides, on which small plate the internal pouch is brought together, such that folding the said small plate causes the rupture of the internal pouch.

17. The package according to claim 16, in which the small plate is provided with a central flat zone.

18. The package according to claim 16, in which the small plate is provided with a trans-verse groove perpendicular to the length of the small plate, the groove having the appearance of a slit affecting the entire length of the small plate, a slit whose depth reaches a part of the thickness of latter, the remaining material playing a role of an integrated hinge.

19. The package according to claim 16, in which the groove is provided with sharp edges.

20. The package according to claim 16, in which the groove has a straight appearance.

21. The package according to claim 16, in which the groove is not consistently straight, but having a linearity that is interrupted to take on the form of an elbowed tooth, with subsequent continuation of the linearity.

22. The package according to claim 16, in which the small plate is executed in two pieces glued one to the other along the plane of the groove or slit, with hinge added, made of a supple material, thus replacing an integral hinge.

* * * * *